US005637361A

United States Patent [19]

Scheurich

[11] Patent Number: 5,637,361

[45] Date of Patent: Jun. 10, 1997

[54] TABLETOP FOUNTAIN

[76] Inventor: Ronald Scheurich, Im Bergsiek 43, D-33739 Bielefeld, Germany

[21] Appl. No.: 289,138

[22] Filed: Aug. 11, 1994

[30] Foreign Application Priority Data

Aug. 30, 1993 [DE] Germany ..... 9312982 U

[51] Int. Cl.[6] ..... F21P 7/00

[52] U.S. Cl. ..... 428/13; 40/406; 362/96; 428/15

[58] Field of Search ..... 428/15, 13, 17; 40/406; 362/96

[56] References Cited

U.S. PATENT DOCUMENTS

| | | | |
|---|---|---|---|
| 1,728,456 | 9/1929 | Stuewe | 362/96 X |
| 3,390,665 | 7/1968 | Wininger | 428/15 X |
| 4,352,149 | 9/1982 | Stetler | 428/13 X |
| 4,369,216 | 1/1983 | Willinger | 428/17 |
| 5,234,728 | 8/1993 | Chiang | 428/15 X |

*Primary Examiner*—Henry F. Epstein
*Attorney, Agent, or Firm*—Herbert L. Lerner; Laurence A. Greenberg

[57] ABSTRACT

A tabletop fountain includes a water reservoir. A recirculating pump is disposed in the water reservoir. An ascending water pipe is connected to the pump. A sheathing that is advantageously formed of rock or rock-like material, guides and at least partially covers or hides the water pipe. A plant dish is insertable into the water reservoir. A cover has holes formed therein. An upwardly oriented separating strip is disposed on the cover.

22 Claims, 6 Drawing Sheets

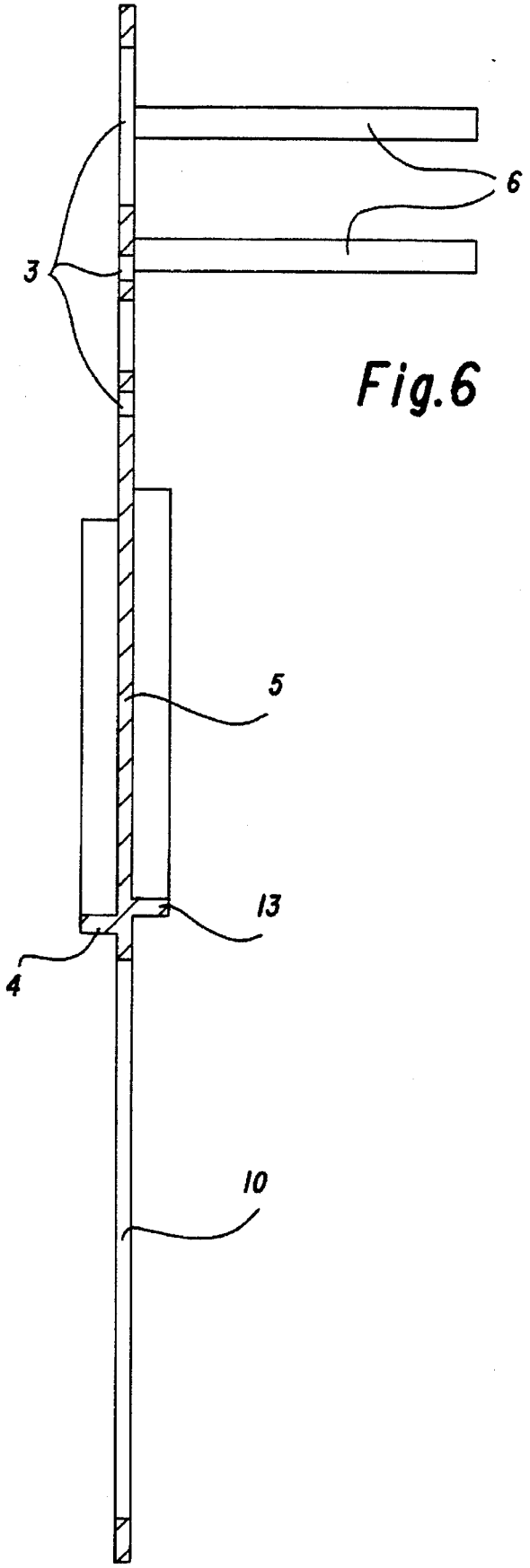
Fig.6
Fig.7
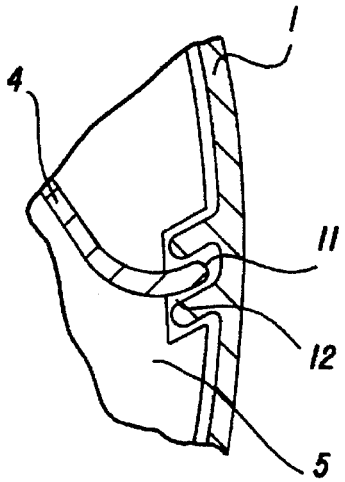

TABLETOP FOUNTAIN

BACKGROUND OF THE INVENTION

1. Field of the Invention

The invention relates to a tabletop fountain having a recirculating pump disposed in a water reservoir and an ascending water pipe being connected to the pump and being guided and suitably covered or hidden by a sheathing being placed on top and being advantageously formed of a rock or a rock-like material.

The plantings in known tabletop fountains are subject to certain difficulties, because preventing soil from being washed away by water circulation generated by the pump is either impossible or can only be accomplished with a large effort.

2. Summary of the Invention

It is accordingly an object of the invention to provide a tabletop fountain, which overcomes the hereinaforementioned disadvantages of the heretofore-known devices of this general type and which does so in such a way that a wash-out of soil for plantings is prevented.

With the foregoing and other objects in view there is provided, in accordance with the invention, a tabletop fountain, comprising a water reservoir; a recirculating pump disposed in the water reservoir; an ascending water pipe connected to the pump; a sheathing being advantageously formed of rock or rock-like material, guiding and at least partially covering or hiding the top of the water pipe; a plant dish to be inserted into the water reservoir; a cover for the water reservoir having holes formed therein; and an upwardly oriented or directed separating strip disposed on the cover.

In accordance with another feature of the invention, the plant dish has a kidney-shaped cross section.

In accordance with a further feature of the invention, the plant dish has an upper edge on which the cover is placed or seated, the water reservoir has an upper edge, and the cover is disposed at a distance from the upper edge of the water reservoir.

In accordance with an added feature of the invention, the cover has a lower surface, and there is provided a plurality of vertically extending spacers being disposed on the lower surface of the cover, the plant dish having a given height, and the spacers having a height corresponding to the given height.

In accordance with an additional feature of the invention, the spacers are disposed outside the plant dish.

In accordance with yet another feature of the invention, the water reservoir has an interior wall surface with a given course, and the cover has an outer edge being adapted to the given course. In accordance with yet a further feature of the invention, the water reservoir is circular.

In accordance with yet an added feature of the invention, the holes include circular openings being formed in the cover in the vicinity of the plant dish. In accordance with yet an additional feature of the invention, the plant dish is kidney-shaped and has an exterior wall surface with a given course, and the openings have diameters being adapted to the given course. In accordance with again another feature of the invention, the circular openings are three circular openings.

In accordance with again a further feature of the invention, the plant dish is kidney-shaped and has a given course, and the upwardly oriented separating strip is adapted to the given course. In accordance with again an added feature of the invention, there are provided sealing grooves, the separating strip having end surfaces being inserted into the sealing grooves, and the water reservoir having an interior wall surface on which the sealing grooves are disposed. In accordance with again an additional feature of the invention, the cover has a lower surface, the separating strip has a given course, and there is provided a reinforcement rib corresponding to the given course and being disposed on the lower surface of the cover. In accordance with still another feature of the invention, the separating strip and the reinforcement rib are mutually offset. In accordance with still a further feature of the invention, the plant dish is kidney-shaped and the reinforcement rib is a stop on the plant dish.

In accordance with still an added feature of the invention, the holes include perforations disposed outside the vicinity of the plant dish. In accordance with still an additional feature of the invention, the perforations have the shape of slits or circles.

In accordance with a concomitant feature of the invention, the water reservoir, the plant dish and the cover are formed of an injection molded synthetic material.

The structure according to the invention permits the separation of the plant dish from the water moving in circulation through the recirculating pump. The water flowing out of the ascending water pipe is prevented from reaching the area of the plant dish by means of the disposition of the separating strip.

Other features which are considered as characteristic for the invention are set forth in the appended claims.

Although the invention is illustrated and described herein as embodied in a tabletop fountain, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 6 is a sectional view of a cover; and

FIG. 7 is an enlarged, fragmentary, horizontal-sectional view showing an insertion of a front end of a separating strip into a sealing groove.

DESCRIPTION OF THE PREFERRED EMBODIMENTS

Figure 1:
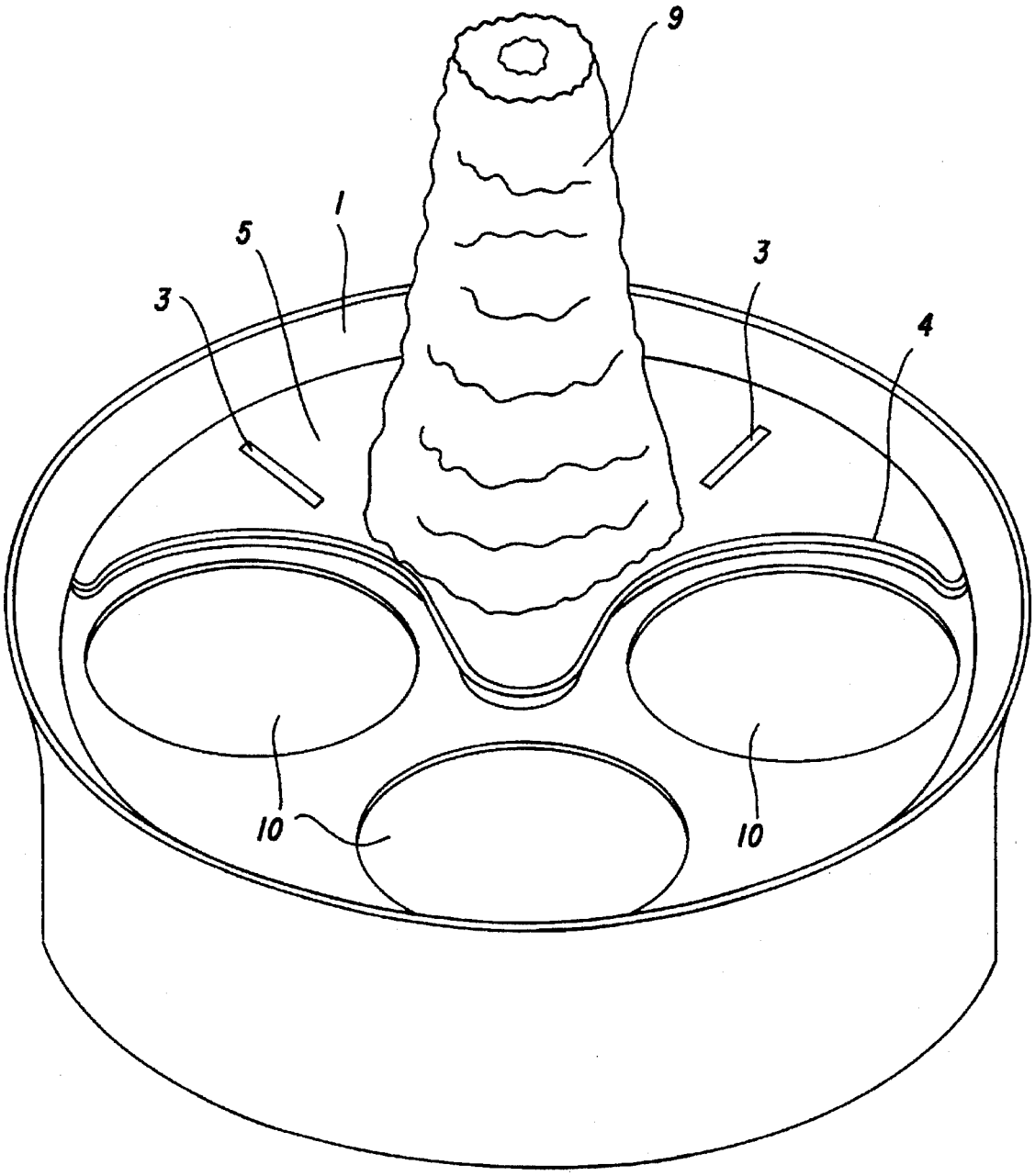
FIG. 1 is a diagrammatic perspective view of a tabletop fountain.
Figure 2:
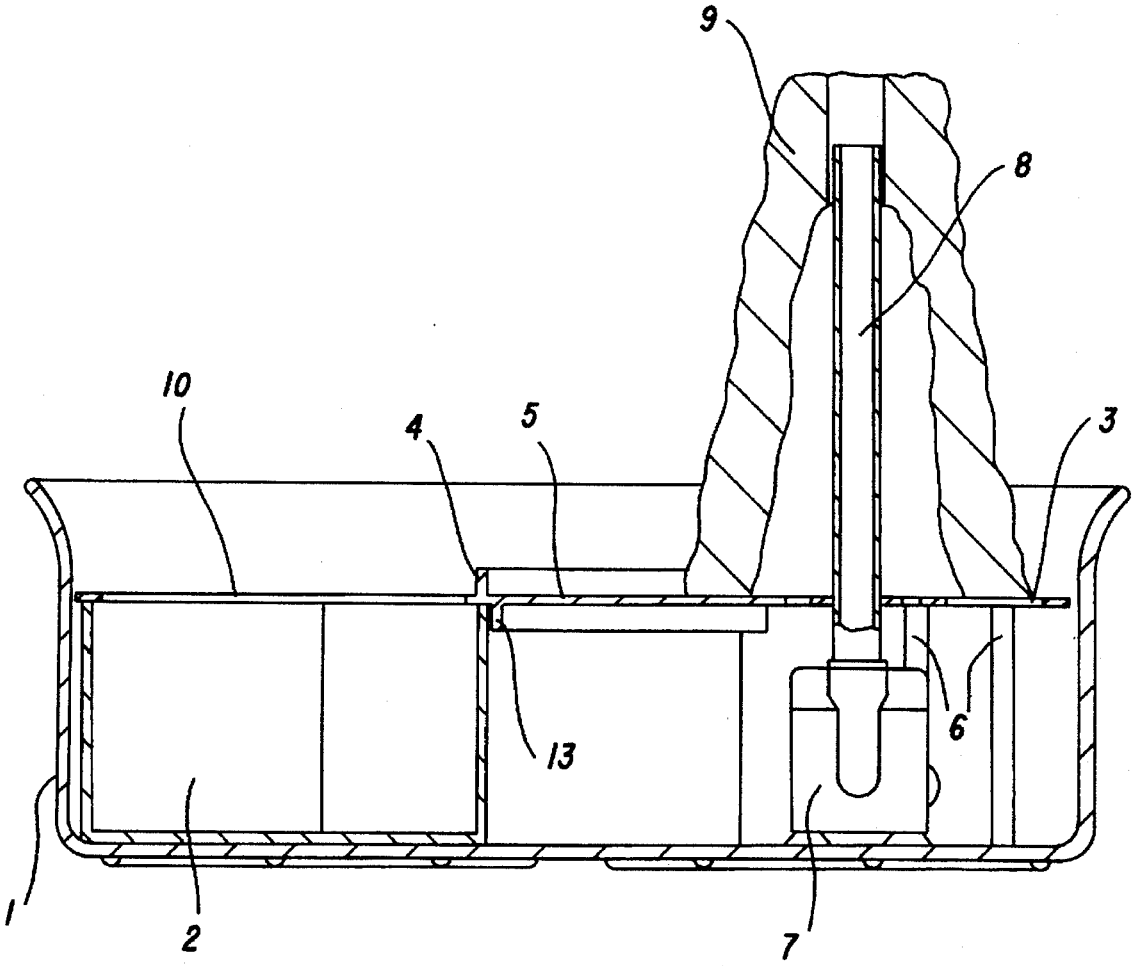
FIG. 2 is a vertical-sectional view of a tabletop fountain.
Figure 5:
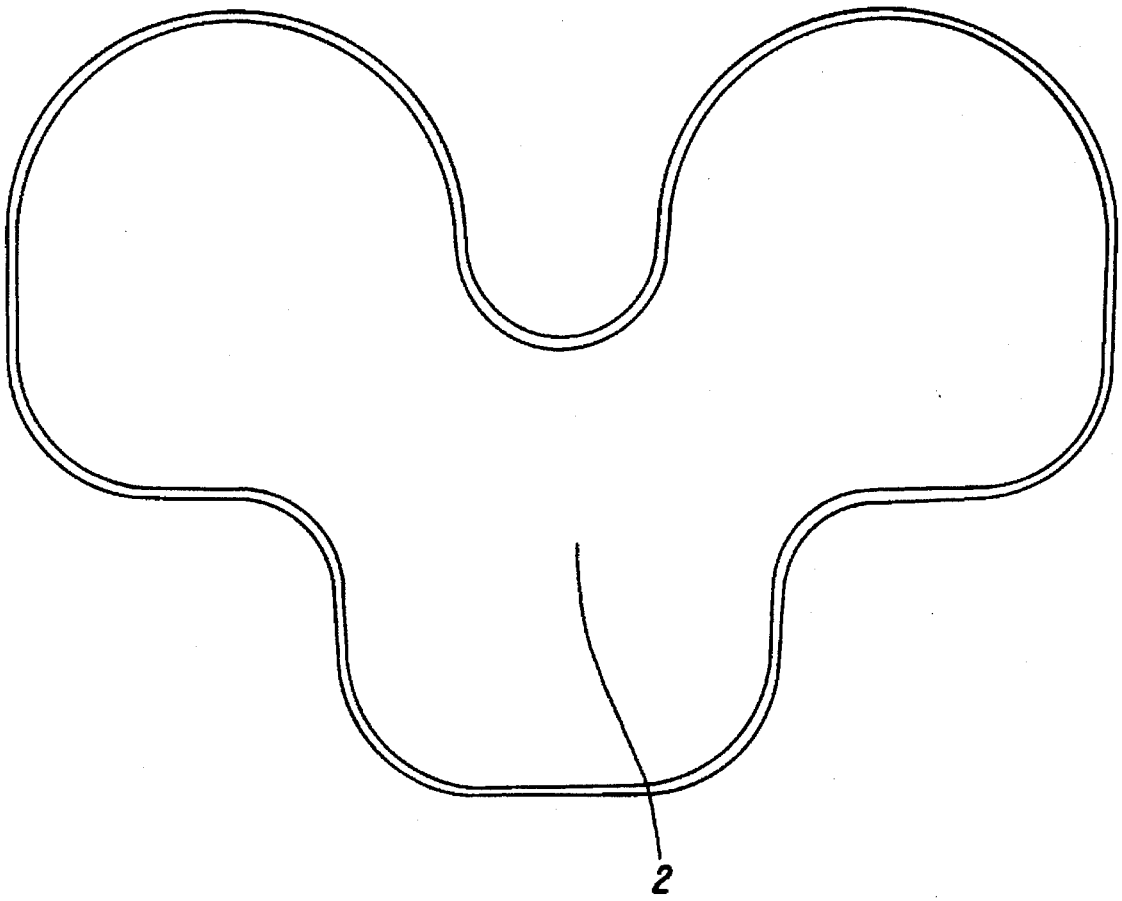
FIG. 5 is a top-plan view of a kidney-shaped plant dish.

Referring now to the figures of the drawing in detail and first, particularly, to FIGS. 1 and 2 thereof, there is seen a recirculating pump 7 with an associated ascending water pipe 8 which is disposed in a circular water reservoir 1. The ascending water pipe 8 is guided through a sheathing 9 of a rock or a rock-like material such as a pumice cap stone. A kidney-shaped plant dish 2, that is best seen in FIG. 5, is placed into the water reservoir 1 and is used for a planting. Thus, plants are completely separated from the water being recirculated by the recirculating pump 7. The entire water reservoir 1 is closed off at the top by a cover 5 which is placed on an upper edge of the plant dish 2 for this purpose. The cover 5, which is best seen in FIG. 6, extends at a distance from an upper edge of the water reservoir 1 and an outer edge of the cover 5 is adapted to an interior wall surface of the water reservoir 1. A plurality of vertically extending spacers 6 which are disposed on a lower surface of the cover 5 in a region outside the plant dish 2, have a height that corresponds to the height of the plant dish 2.

Figure 3:
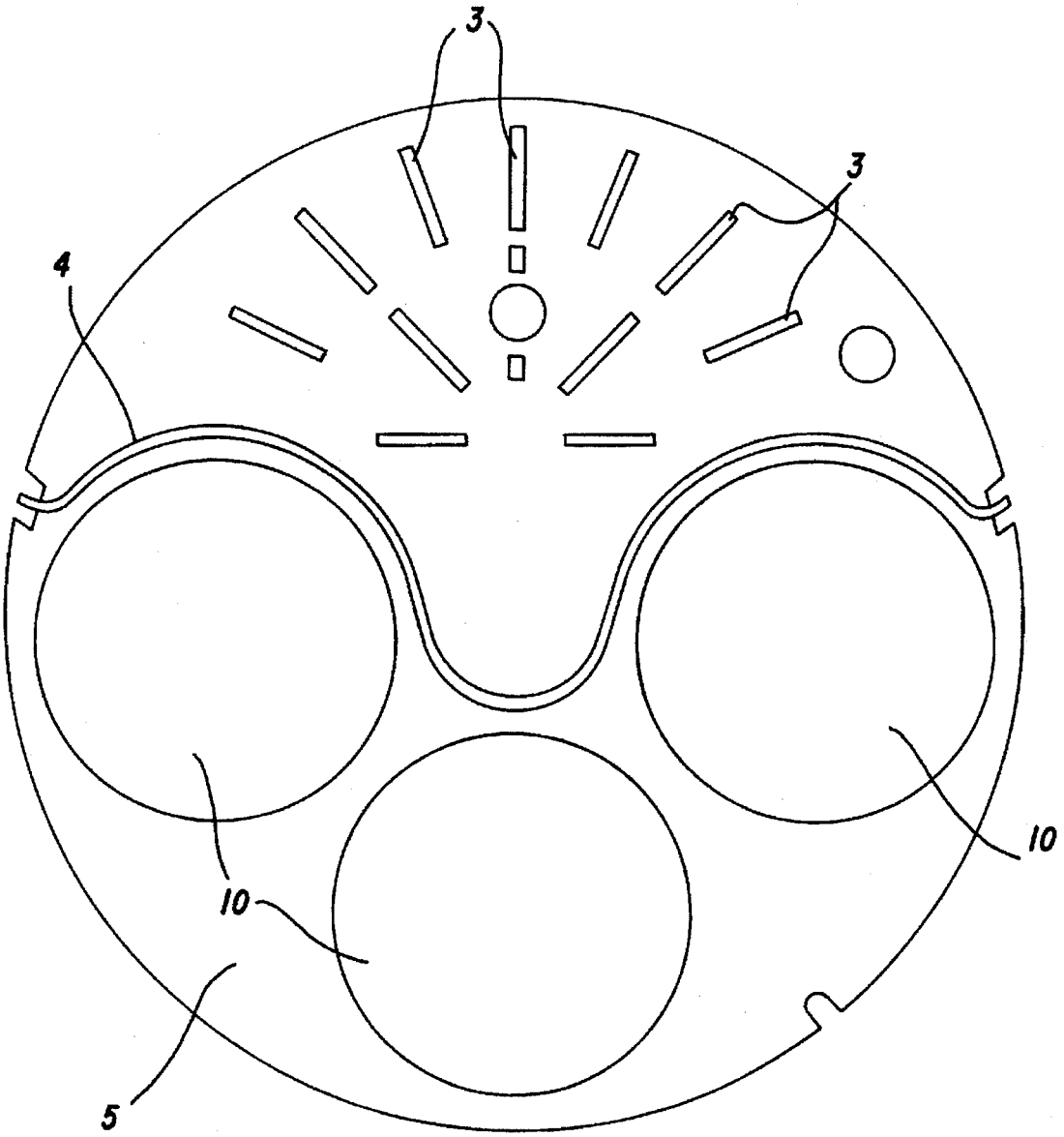
FIG. 3 is a top-plan view of a cover.

Three circular holes or openings 10 are formed in the cover 5 in the vicinity of the plant dish 2. The openings 10 have a diameter which is adapted to the course of an exterior wall surface of the kidney-shaped plant dish 2. A separating strip 4 which is provided on the top of the cover 5, as is best seen in FIG. 3, has a curved shaped which is adapted to the edge of the plant dish 2.

As is best shown in FIG. 7, in order to prevent the water supplied through the ascending water pipe 8 from flowing into the plant dish 2, end surfaces 11 of the separating strip 4 are seated in sealing grooves 12 disposed in an interior wall surface of the water reservoir 1.

Figure 4:
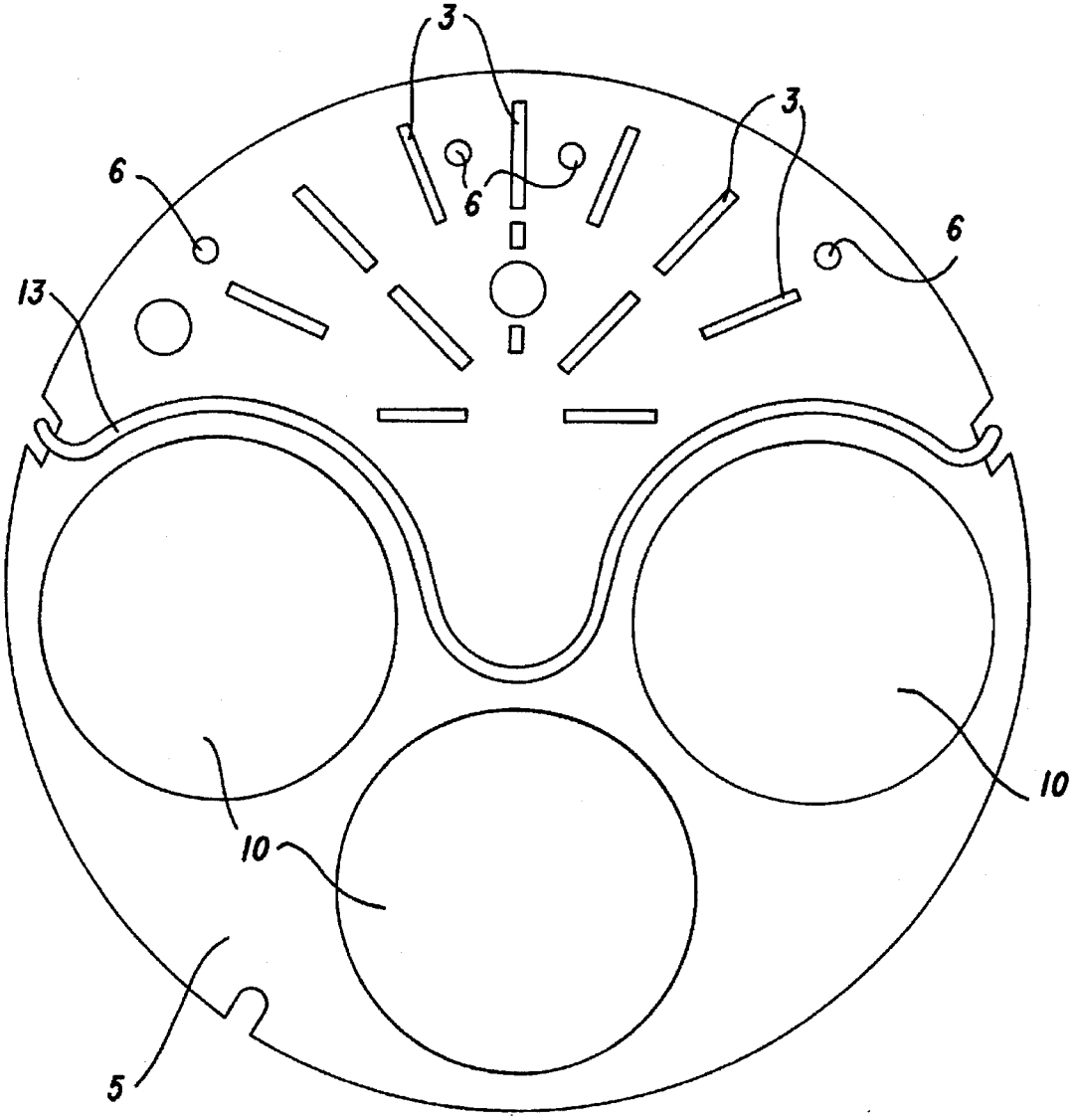
FIG. 4 is a bottom-plan view of a cover.

As is best shown in FIGS. 4 and 7, a reinforcement strip 13 which is disposed on the lower surface of the cover 5 is offset with respect to the separating strip 4, corresponds to the course of the separating strip 4 and is constructed as a stop on the kidney-shaped plant dish 2. A plurality of slit-shaped holes in the form of perforations 3 are provided in the cover 5 outside of the region of the plant dish 2, so that the water can return through the perforations 3 into the water reservoir 1.

An arbitrary filler material which can be applied to the cover 5 outside of the vicinity of the plant dish 2. The filler material has a height being determined by the height of the separating strip 4. The filler material is confined by the separating strip 4 and a part of the wall surface of the water reservoir 1 which is defined by the separating strip 4.

I claim:

1. A tabletop fountain, comprising:

a water reservoir defining a base of a tabletop fountain;

a recirculating pump disposed in said water reservoir;

an ascending water pipe connected to said pump and ascending above said water reservoir;

a sheathing guiding and at least partially covering said water pipe;

a plant dish inserted into said water reservoir;

a cover for said water reservoir having holes formed therein; and an upwardly oriented separating strip disposed on said cover for preventing water pumped through said water pipe from flowing into said plant dish.

2. The tabletop fountain according to claim 1, wherein said plant dish has a kidney-shaped cross section.

3. The tabletop fountain according to claim 1, wherein said plant dish has an upper edge on which said cover is placed.

4. The tabletop fountain according to claim 1, wherein said water reservoir has an upper edge, and said cover is disposed at a distance from said upper edge of said water reservoir.

5. The tabletop fountain according to claim 1, wherein said cover has a lower surface, and including a plurality of vertically extending spacers being disposed on said lower surface of said cover.

6. The tabletop fountain according to claim 5, wherein said plant dish has a given height, and said spacers have a height corresponding to said given height.

7. The tabletop fountain according to claim 5, wherein said spacers are disposed outside said plant dish.

8. The tabletop fountain according to claim 1, wherein said water reservoir has an interior wall surface with a given course, and said cover has an outer edge being adapted to said given course.

9. The tabletop fountain according to claim 1, wherein said water reservoir is circular.

10. The tabletop fountain according to claim 1, wherein said holes include circular openings being formed in said cover above said plant dish.

11. The tabletop fountain according to claim 10, wherein said plant dish is kidney-shaped and has an exterior wall surface with a given course, and said openings have diameters being adapted to said given course.

12. The tabletop fountain according to claim 10, wherein said circular openings are three circular openings.

13. The tabletop fountain according to claim 1, wherein said plant dish is kidney-shaped and has a given course, and said upwardly oriented separating strip is adapted to said given course.

14. The tabletop fountain according to claim 13, including sealing grooves, said separating strip having end surfaces being inserted into said sealing grooves.

15. The tabletop fountain according to claim 14, wherein said water reservoir has an interior wall surface on which said sealing grooves are disposed.

16. The tabletop fountain according to claim 1, wherein said cover has a lower surface, said separating strip has a given course, and including a reinforcement rib corresponding to said given course and being disposed on said lower surface of said cover.

17. The tabletop fountain according to claim 16, wherein said separating strip and said reinforcement rib are mutually offset.

18. The tabletop fountain according to claim 16, wherein said plant dish is kidney-shaped and said reinforcement rib is a stop on said plant dish.

19. The tabletop fountain according to claim 1, wherein said holes include perforations disposed outside the vicinity of said plant dish.

20. The tabletop fountain according to claim 19, wherein said perforations have at least one shape selected from the group consisting of slits and circles.

21. The tabletop fountain according to claim 1, wherein said water reservoir, said plant dish and said cover are formed of an injection molded synthetic material.

22. The tabletop fountain according to claim 1, wherein said sheathing is formed of a material selected from the group consisting of rock and a material resembling rock.

* * * * *